US005488403A

United States Patent [19]

Nagahata

[11] Patent Number: 5,488,403

[45] Date of Patent: Jan. 30, 1996

[54] PRINTING ELEMENT DRIVE DEVICE HAVING SEPARATELY OPERATING SHIFT REGISTERS

[75] Inventor: Takaya Nagahata, Kyoto, Japan

[73] Assignee: Rohm Co., Ltd., Kyoto, Japan

[21] Appl. No.: 86,501

[22] Filed: Jul. 1, 1993

[30] Foreign Application Priority Data

Jul. 31, 1992 [JP] Japan ..... 4-204841

[51] Int. Cl.[6] ..... B41J 2/355

[52] U.S. Cl. ..... 347/211; 347/180; 347/182

[58] Field of Search ..... 346/76 PH, 107 R, 346/108; 400/120, 120.05, 120.06; 347/211, 180, 182

[56] References Cited

U.S. PATENT DOCUMENTS

| | | | |
|---|---|---|---|
| 4,492,482 | 1/1985 | Eguchi et al. . | |
| 4,575,732 | 3/1986 | Kitaoka | 346/76 PH |
| 4,609,927 | 9/1986 | Yoshida | 346/154 |
| 4,689,694 | 8/1987 | Yoshida | 358/298 |

FOREIGN PATENT DOCUMENTS

| | | | |
|---|---|---|---|
| 0228708 | 7/1987 | European Pat. Off. . | |
| 0064965 | 4/1984 | Japan | 346/76 PH |

*Primary Examiner*—Huan H. Tran

*Attorney, Agent, or Firm*—Brumbaugh, Graves, Donohue & Raymond

[57] ABSTRACT

A plurality (n) of heating elements are driven by respective drive elements in accordance with printing data stored in first and second shift registers each having at least n/2 memory cells. Common bit-serial printing data is input to the first and second shift registers. In a first period, new printing data of n/2 bits is stored into the first shift register by application of a first clock signal and printing data already stored in the second shift register is provided to the associated drive elements. In a second period, new printing data of n/2 bits is stored into the second register by application of a second clock signal and printing data already stored in the first shift register is provided to the associated drive elements. The first and second shift registers may include an equal number of dummy memory cells for storing dummy printing data, in which case the part of the drive elements associated with the dummy memory cells are not connected to any printing elements.

5 Claims, 5 Drawing Sheets

PRINTING ELEMENT DRIVE DEVICE HAVING SEPARATELY OPERATING SHIFT REGISTERS

BACKGROUND OF THE INVENTION

The present invention relates to printing element drive devices such as a thermal printing head (thermal head) and a LED printing head.

Among the drive methods in a printing element drive device such as a thermal head is a latch-less control type drive method. This type of drive method uses, for instance, a drive circuit as shown in FIG. 1 consisting of a shift register 2 having n memory cells $D_1$ to $D_n$ for n respective heating elements $\mathbf{1}_1$ to $\mathbf{1}_n$ and drive elements $\mathbf{3}_1$ to $\mathbf{3}_n$ that receive respective memory cell outputs of the shift register 2 and a strobe signal STB1 (inverted) or STB2 (inverted). In this drive circuit, at first serial printing data DI of n bits are stored into the shift register 2 while n pulses of a clock signal CLK are applied to the shift register 2. Then, while the strobe signal STB1 is in an on-state, the drive elements $\mathbf{3}_1$ to $\mathbf{3}_{n/2}$ operate to drive the heating elements $\mathbf{1}_1$ to $\mathbf{1}_{n/2}$. Then, while the strobe signal STB2 is in an on-state, the drive elements $\mathbf{3}_{n/2+1}$ to $\mathbf{3}_n$ operate to drive the heating elements $\mathbf{1}_{n/2+1}$ to $\mathbf{1}_n$.

As shown in FIG. 2, in the conventional latch-less control type drive method, a data transfer period is provided outside the periods in which the strobe signal STB1 or STB2 is in an on-state. This is because if the printing data is transferred during the strobe signal on-period, the heating dots change in the midst of printing to prohibit a normal printing operation.

The one printing period SLT including the data transfer period is usually set at about 10 msec. To provide the data transfer period outside the strobe signal on-periods under the restriction of this printing period, there is no other measure than shortening the strobe signal on-periods. However, to assure sufficient printing density, it is much desired to avoid the shortening of the strobe signal on-periods. On the other hand, if the transfer rate is increased (for instance to 4 MHz) from the conventional case (for instance 1 MHz), noise problems may occur.

The above-mentioned number n takes such values as 1,056 and 2,048, and the shift register 2 and the drive elements $\mathbf{3}_1$ to $\mathbf{3}_n$ are constituted of a plurality of IC chips of 64 or 96 bits. Therefore, it is not always the case that the number n (number of dots of the thermal head to be driven) is not divided by the number N of dots of the IC chips used. Conventionally, where the use of m IC chips causes a fraction and (m-1) IC chips are insufficient for the n dots, the shift register 2 having mN memory bit cells is formed by m IC chips, and (mN-n) fractional cells serve to store dummy bits that are not related to the printing in which the associated drive elements are not connected to any heating elements (non-contact drive elements), as shown in FIG. 3.

However, the non-contact drive elements are provided only in the IC chips associated with only one of the two strobe signals, drive currents when the strobe signal STB1 is applied differ from those when the strobe signal STB2 is applied. This will cause unevenness in the printing density distribution.

SUMMARY OF THE INVENTION

The present invention has been made in view of the above problems in the art, and has an object of providing a printing element drive device which can assure sufficient printing density and is hardly affected by noise etc.

Another object of the invention is to provide a printing element drive device which hardly causes unevenness in the printing density distribution.

According to the invention, a printing element drive circuit comprises:

n printing elements;

first and second shift registers each having at least n/2 memory cells, the first and second shift registers receiving common bit-serial printing data and receiving first and second clock pulse signals respectively, wherein in a first period a first part of the printing data of n/2 bits is stored into the first shift register by application of the first clock signal and in a second period a second part of the printing data of n/2 bits is stored into the second register by application of the second clock signal; and at least n drive elements for driving the n printing elements in accordance with the printing data stored in the first and second shift registers, the printing elements being in one-to-one correspondence with the memory cells of the first and second shift registers.

The first and second shift registers may comprise an equal number of dummy memory cells for storing dummy data included in the printing data, in which case a part of the drive elements associated with the dummy memory cells are not connected to any printing elements.

DESCRIPTION OF THE PREFERRED EMBODIMENTS

The present invention is described hereinafter by way of embodiments.

Figure 1:
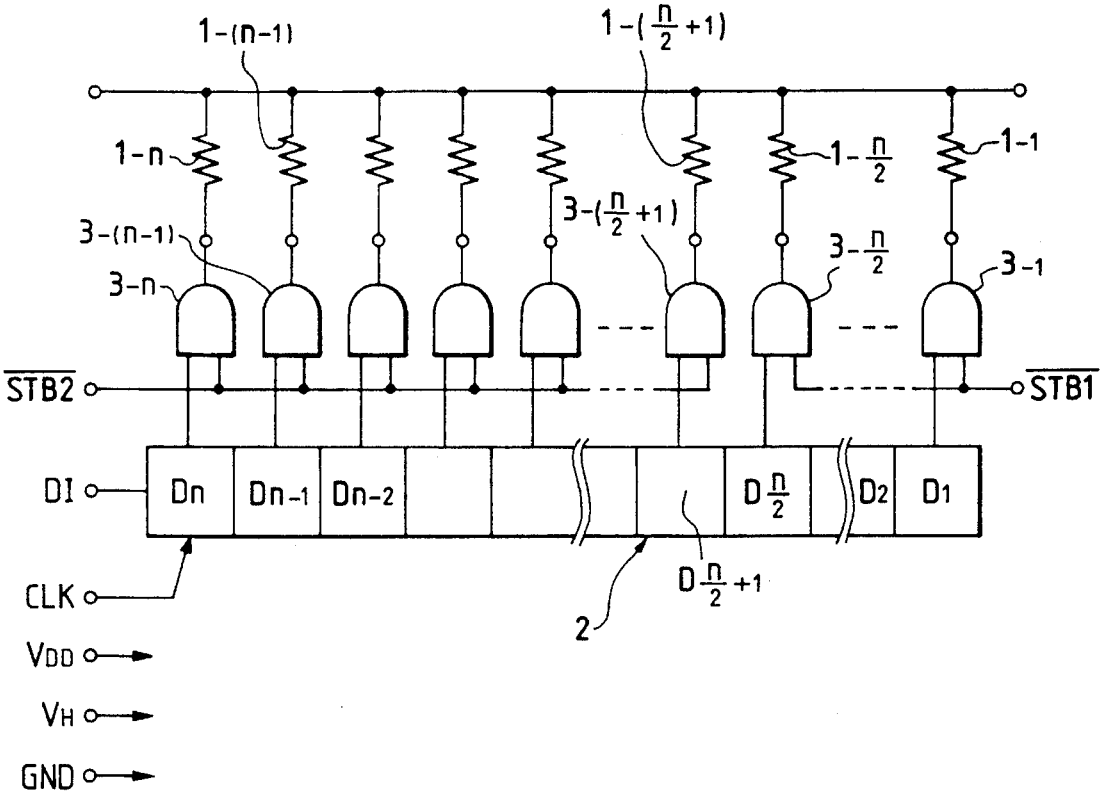
FIG. 1 PRIOR ART
FIG. 1 is a circuit diagram showing general constitution of a conventional latch-less type thermal head drive circuit.
Figure 2:
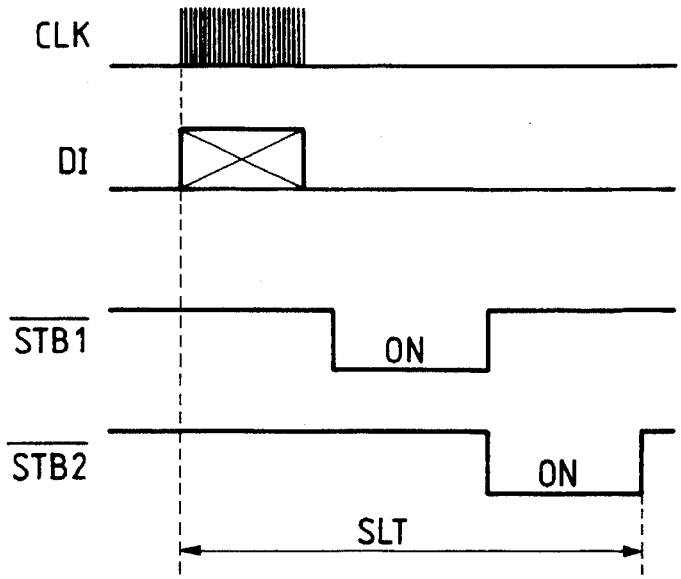
FIG. 2 PRIOR ART
FIG. 2 is a time chart showing the operation of the thermal head drive circuit of FIG. 1.
Figure 3:
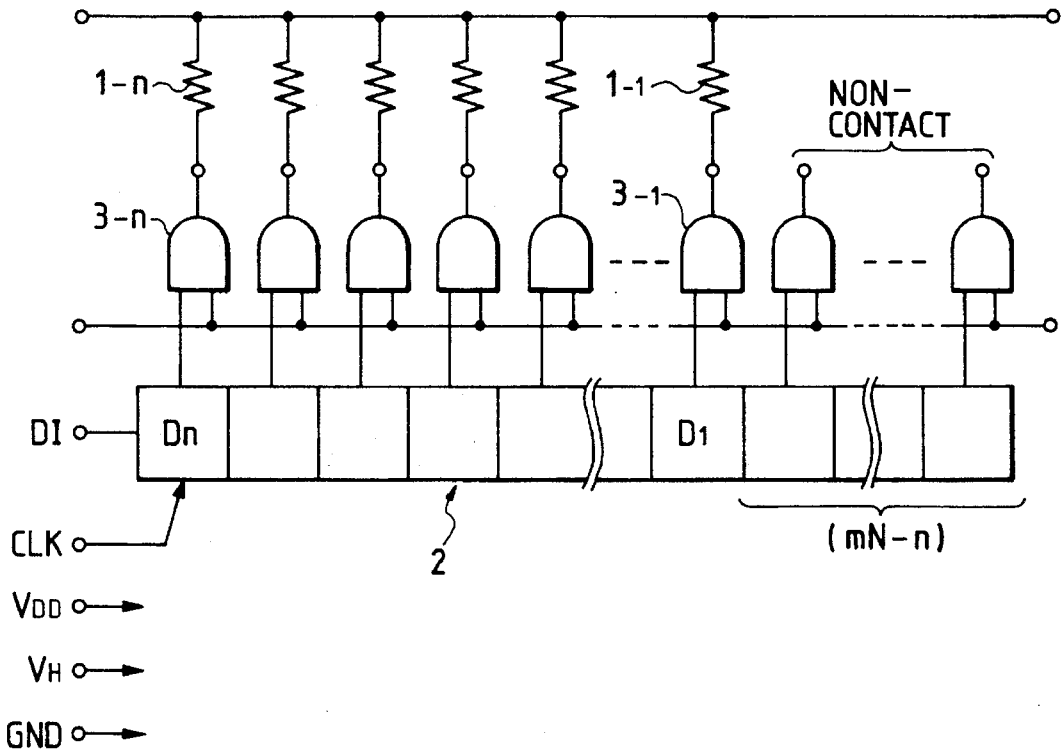
FIG. 3 PRIOR ART
FIG. 3 is a circuit diagram showing general constitution of another conventional latch-less type thermal head drive circuit.
Figure 4:
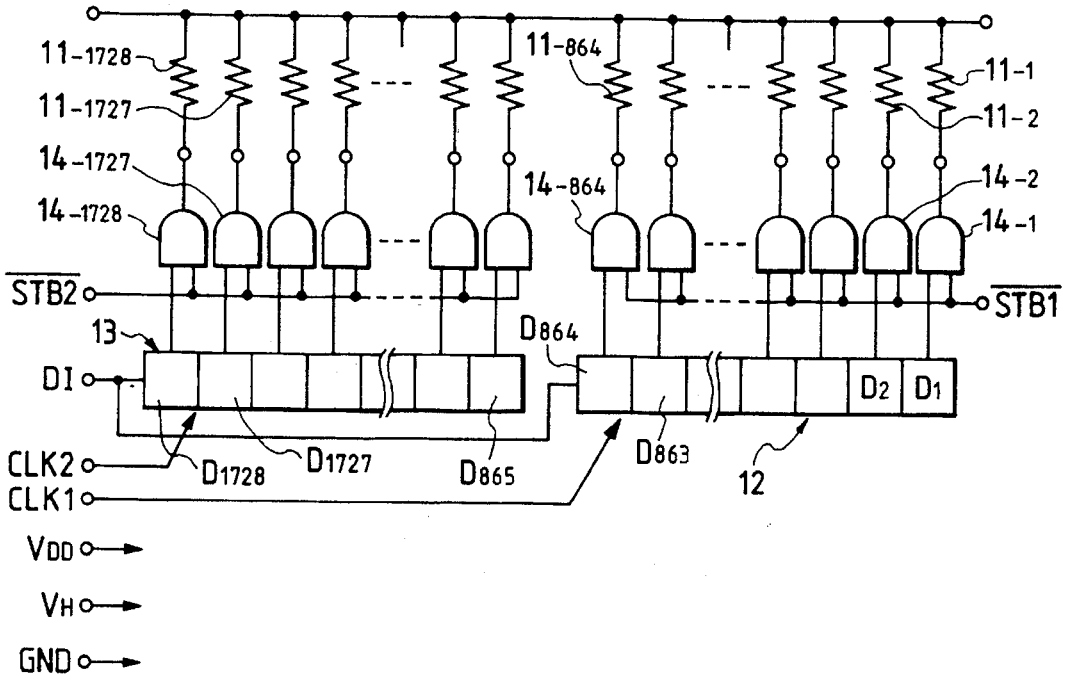
FIG. 4 is a circuit diagram showing general constitution of a thermal head drive circuit according to a first embodiment of the present invention.

FIG. 4 is a circuit diagram showing general constitution of a thermal head drive circuit according to an embodiment of the invention. The thermal head drive circuit consists of 1,728 heating elements (printing elements) $\mathbf{11}_1$ to $\mathbf{11}_{1,728}$, a first shift register 12 in the form of a series connection of 864 memory cells $D_1$ to $D_{864}$, a second shift register 13 in the form of a series connection of 864 memory cells $D_{865}$ to $D_{1,728}$, drive elements $\mathbf{14}_1$ to $\mathbf{14}_{1,728}$ for driving the respective heating elements $\mathbf{11}_1$ to $\mathbf{11}_{1,728}$.

This drive circuit is for the A4-size sheet. The first and second shift registers 12 and 13 and the drive elements $\mathbf{14}_1$ to $\mathbf{14}_{1,728}$ are constituted of 18 IC chips each having a shift register of 96-bit memory cells and 96-dot drive elements. That is, each of the first and second shift registers 12 and 13 is a series connection of nine IC chips (shift registers).

Single printing data DI is commonly applied to the inputs of the first and second shift registers 12 and 13. On the other hand, clock pulse signals CLK1 and CLK2 are separately applied to the first and second shift registers 12 and 13. Further, a strobe signal STB1 (inverted) is applied to the drive elements $\mathbf{14}_1$ to $\mathbf{14}_{864}$, and a strobe signal STB2 (inverted) is applied to the drive elements $\mathbf{14}_{865}$ to $\mathbf{14}_{1,728}$.

In this drive circuit, the transfer (i.e., input) of the printing data DI of 1,728 dots is performed in a serial manner. First, 864 pulses of the clock signal CLK1 are applied to the first shift register 12 to store the printing data of 864 dots into the first shift register 12. After completion of this storage, 864 pulses of the clock signal CLK2 are applied to the second shift register 13 to store the printing data DI of the remaining 864 dots into the second shift register 13.

Figure 5:
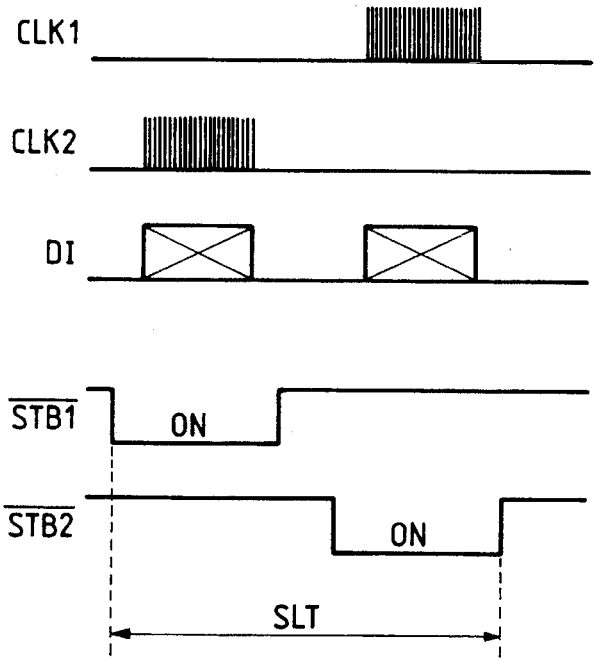
FIG. 5 is a time chart showing the operation of the thermal head drive circuit of FIG. 4.

While the printing data DI is transferred to the second shift register 13, the strobe signal STB1 (inverted) is turned on and the drive elements $\mathbf{14}_1$ to $\mathbf{14}_{864}$ operate to effect a printing operation of the heating elements $\mathbf{11}_1$ to $\mathbf{11}_{864}$ in accordance with the printing data DI stored in the first shift register 12. Then, by application of the clock pulse signal CLK1, the printing data DI of the next 864 dots is input to and stored in the first shift register 12. During this period, the strobe signal STB2 (inverted) is turned on and the heating elements $\mathbf{11}_{865}$ to $\mathbf{11}_{1,728}$ perform their printing operation in accordance with the printing data DI stored in the second shift register 13 (see FIG. 5).

According to this embodiment, the printing data DI can be transferred (i.e., input) to one shift register while the strobe signal associated with the other shift register is in an on-state. Therefore, it is not necessary to shorten the on-period of the strobe signals or increase the transfer rate of the printing data DI. As a result, sufficient printing density can be assured while noise problems are avoided.

Figure 6:
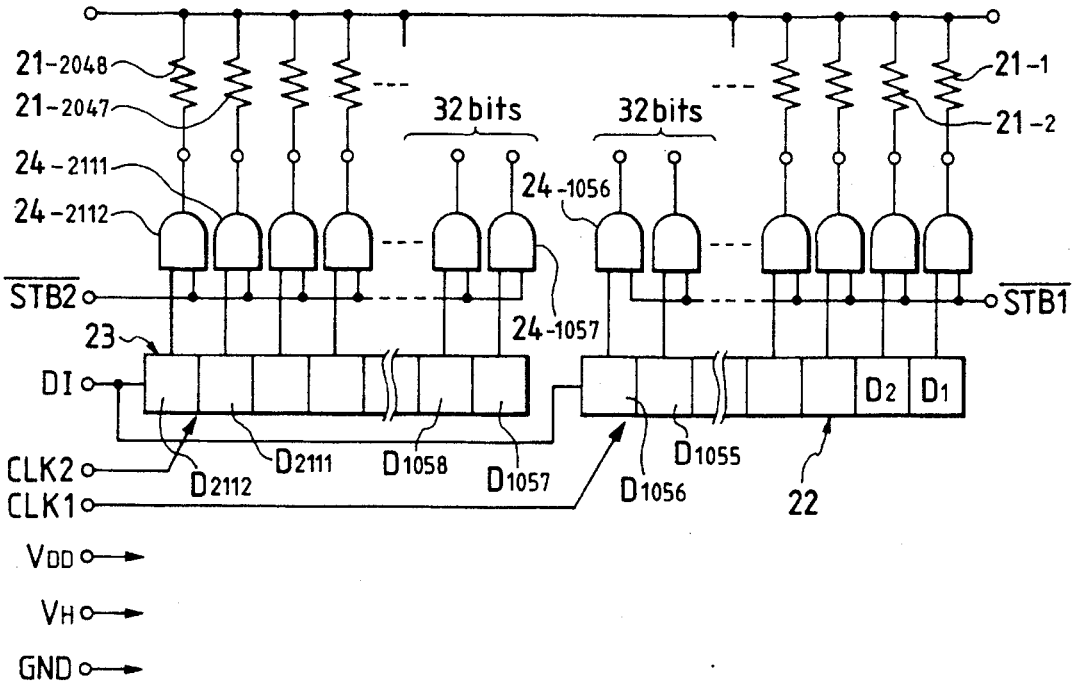
FIG. 6 is a circuit diagram showing general constitution of a thermal head drive circuit according to a second embodiment of the invention.

FIG. 6 is a circuit diagram showing general constitution of a thermal head drive circuit according to another embodiment of the invention. This drive circuit is for the B4-size sheet, and consists of 2,048 heating elements $\mathbf{21}_1$ to $\mathbf{21}_{2,048}$, a first shift register 22 in the form of a series connection of 1,056 memory cells $D_1$ to $D_{1,056}$, a second shift register 23 in the form of a series connection of 1,056 memory cells $D_{1,057}$ to $D_{2,112}$, and drive elements $\mathbf{24}_1$ to $\mathbf{24}_{2,112}$ for driving the heating elements $\mathbf{21}_1$ to $\mathbf{21}_{2,048}$.

In this drive circuit, the first and second shift registers 22 and 23 and the drive elements $\mathbf{24}_1$ to $\mathbf{24}_{2,112}$ are constituted of 22 IC chips each having a shift register of 96-bit memory cells and 96-dot drive elements.

Since 2,048 dots are required for the B4-size sheet, there remain memory cells or drive elements of 64 dots (2,112–2,048=64) if 22 IC chips of 96 dots are used. If, as in the conventional case, all the pins of each of the 11 IC chips associated with one strobe signal were used to provide effective drive elements of 1,056 dots and 64 pins of one of the 11 IC chips associated with the other strobe signal were not used to provide effective drive elements of 992 dots, the drive currents would not be balanced to cause unevenness in the printing density distribution.

To avoid this problem, in this embodiment, drive elements $\mathbf{14}_{1,025}$ to $\mathbf{14}_{1,056}$ which are 32 input-side drive elements belonging to the single IC chip nearest to the input among the 11 IC chips constituting the first shift register 22 and drive elements $\mathbf{14}_{1,057}$ to $\mathbf{14}_{1,088}$ which are 32 output-side drive elements belonging to the single IC nearest to the output among the 11 IC chips constituting the second shift register 23 are not connected to any heating elements, i.e., they are opened.

In this drive circuit, the printing data DI of 2,112 bits are sequentially transferred. The first 1,024 bits are true printing data, the next (32+32) bits are dummy data, and the last 1,024 bits are true data. At first, the printing data of 1,024 bits and the dummy data of 32 bits are stored into the first shift register 22 by the application of 1,056 pulses of a clock signal CLK1. Then, the dummy data of 32 bits and the printing data of 1,024 bits are stored into the second shift register 23 by the application of 1,056 pulses of a clock signal CLK2.

While the printing data DI is transferred to the second shift register 23, a strobe signal STB1 (inverted) is turned on and the drive elements $\mathbf{24}_1$ to $\mathbf{24}_{1,024}$ operate to effect a printing operation of the heating elements $\mathbf{21}_1$ to $\mathbf{21}_{1,024}$ in accordance with the printing data DI stored in the first shift register 22.

In this embodiment, the clock pulse signals CLK1 and CLK2 are switched to store the printing data DI into the first and second shift registers 22 and 23 in a divided manner. Sufficient switching time-can be obtained because of the blank portion of (32+32) dots bridging the boundary of the division.

According to this embodiment, since the portion of the drive elements not connected to any printing elements are equally allocated to the right and left halves of the printing head, the currents flowing through the printing elements are almost equalized to avoid unevenness in the printing density distribution.

Figure 7:
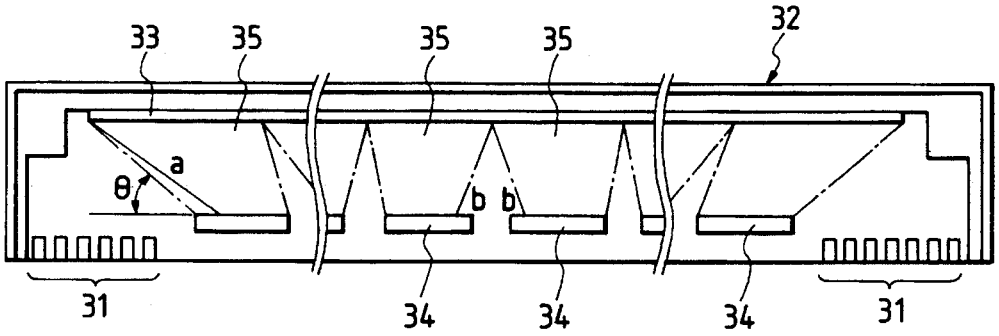
FIG. 7 is a sectional view of a thermal head drive device illustrating connection patterns.

In general, in a thermal head 32 of the type in which pin connectors 31 are provided at the two ends as shown in FIG. 7, an angle θ between an IC chip 34 and a connection pattern 35 for connecting a heating element array 33 and the IC chip 34 greatly influences the width of individual lines of the connection pattern 35. It is preferable that the individual lines be as wide as possible. If the non-contact portions were provided in the IC chips 34 located at the ends of the thermal head 32 as indicated by character a in FIG. 7, the angle θ would tend to be smaller to narrow the individual lines of the connection pattern 35. On the other hand, if the drive circuit of the above embodiment is used, in which case the non-contact portions are provided in the IC chips 34 located at the central portion of the thermal head 32 as indicated by character b in FIG. 7, the angle θ can be increased to widen the individual lines as much.

Figure 8:
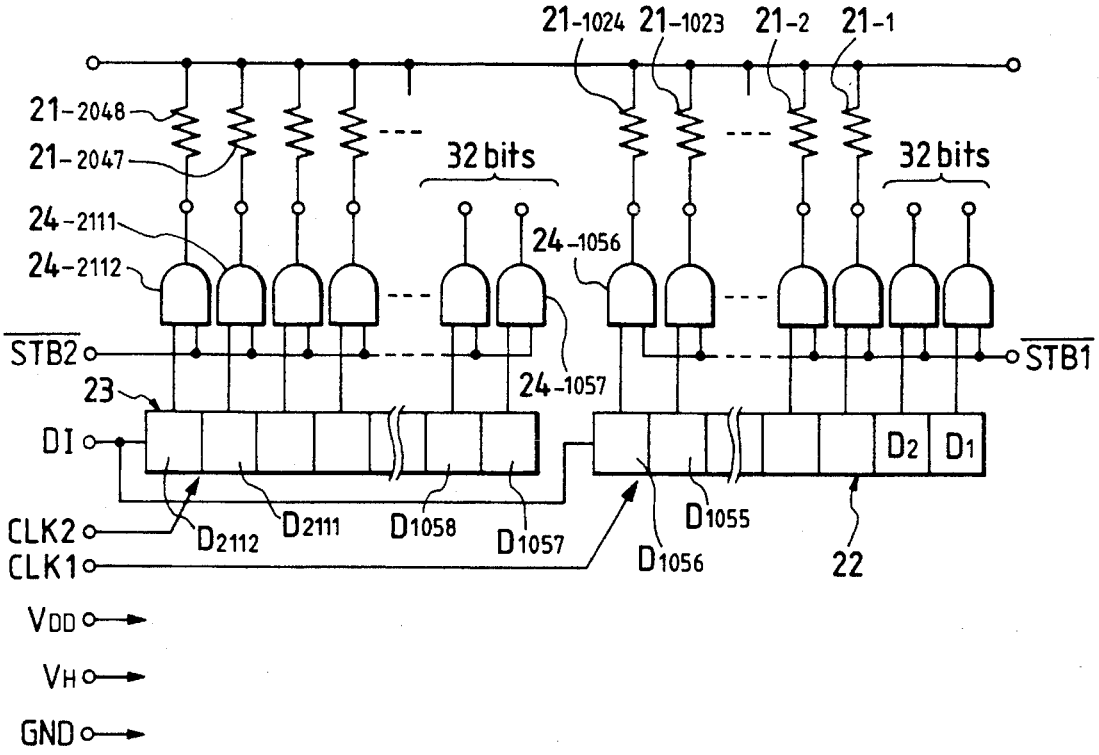
FIG. 8 is a circuit diagram showing a thermal head drive circuit according to a modification of the second embodiment.

FIG. 8 is a circuit diagram showing a modification of the second embodiment (FIG. 6). A thermal head drive circuit of FIG. 8 is different from that of FIG. 6 in that non-contact drive elements associated with the first shift register 22 is located on the output side rather than the input side. This embodiment is advantageous in that the printing data structure including the dummy data for the first shift register 22 can be identical to that for the second shift register 23.

What is claimed is:

1. A printing element drive circuit comprising:

n printing elements;

first and second shift registers each having at least n/2 memory cells, the first and second shift registers receiving common bit-serial printing data and receiving first and second clock pulse signals respectively, wherein in a first period the first shift register stores a first part of the printing data of n/2 bits during application of the first clock signal and in a second period the second shift register stores a second part of the printing data of n/2 bits during application of the second clock signal; and at least n drive elements for driving the n printing elements in accordance with the printing data stored in the first and second shift registers, the printing elements being in one-to-one correspondence with the memory cells of the first and second shift registers.

2. The printing element drive circuit of claim 1, wherein the first and second shift registers comprise an equal number of dummy memory cells for storing dummy data included in the printing data, and wherein a part of the drive elements associated with the dummy memory cells are not connected to any printing elements.

3. The printing element drive circuit of claim 2, wherein the dummy memory cells are provided at an input end portion of the first shift register and an output end portion of the second shift register.

4. The printing element drive circuit of claim 2, wherein the dummy memory cells are provided at an output end portion of each of the first and second shift registers.

5. The printing element drive circuit of claim 2, wherein the first and second shift registers and the drive elements are constituted of m IC chips each including a shift register of N memory cells and N drive elements so as to establish a relationship $(m-1)N<n<mN$, each of the first and second shift registers having an IC chip including $(mN-n)/2$ dummy memory cells.

* * * * *